US010681991B1

(12) United States Patent
Edgar et al.

(10) Patent No.: US 10,681,991 B1
(45) Date of Patent: Jun. 16, 2020

(54) METAL STAYS FOR BUNK BEDS

(71) Applicants: David Ray Edgar, Haleyville, AL (US); Hugh E. Hamrick, Jr., Haleyville, AL (US)

(72) Inventors: David Ray Edgar, Haleyville, AL (US); Hugh E. Hamrick, Jr., Haleyville, AL (US)

( * ) Notice: Subject to any disclaimer, the term of this patent is extended or adjusted under 35 U.S.C. 154(b) by 501 days.

(21) Appl. No.: 15/713,778

(22) Filed: Sep. 25, 2017

(51) Int. Cl.
*A47C 19/02* (2006.01)
*A47C 19/20* (2006.01)

(52) U.S. Cl.
CPC ..... *A47C 19/025* (2013.01); *A47C 19/021* (2013.01); *A47C 19/027* (2013.01); *A47C 19/20* (2013.01); *A47C 19/202* (2013.01)

(58) Field of Classification Search
CPC ... A47C 19/025; A47C 19/027; A47C 19/021; A47C 19/20; A47C 19/202
See application file for complete search history.

(56) References Cited

U.S. PATENT DOCUMENTS

| | | | | |
|---|---|---|---|---|
| 609,703 A | | 8/1898 | Richardson | |
| 1,676,987 A | | 7/1928 | Line | |
| 1,766,190 A | | 6/1930 | Rosenberg et al. | |
| 2,983,931 A | | 5/1961 | Nelson | |
| 3,075,206 A | | 1/1963 | Kendrick, Jr. | |
| 3,605,142 A | * | 9/1971 | Weinhart | A47C 23/062 5/238 |
| RE29,611 E | * | 4/1978 | Lawrence | A47C 19/005 5/131 |
| 4,146,940 A | | 4/1979 | Fredmane et al. | |
| 4,224,704 A | * | 9/1980 | Nowell | A47C 19/005 403/107 |
| 5,012,538 A | * | 5/1991 | Timm | A47C 19/005 5/200.1 |
| 5,920,930 A | * | 7/1999 | Harrow | A47C 21/026 5/200.1 |
| 6,925,666 B2 | * | 8/2005 | Harrow | A47C 19/005 5/201 |
| 7,895,687 B2 | | 3/2011 | Schulte | |
| 8,931,123 B1 | * | 1/2015 | Oh | A47C 19/022 5/132 |
| 9,247,825 B2 | * | 2/2016 | Polevoy | A47C 19/005 |
| 10,039,386 B2 | * | 8/2018 | Hoff | A47C 19/04 |
| 2016/0106222 A1 | * | 4/2016 | Polevoy | A47C 19/005 5/400 |

* cited by examiner

*Primary Examiner* — Robert G Santos
*Assistant Examiner* — Rahib T Zaman
(74) *Attorney, Agent, or Firm* — George L Williamson

(57) ABSTRACT

Method and apparatus for metal bed stays designed primarily for usage on bunk beds, but which could be used on any type bed wherein the metal bed stay includes a horizontal portion upon which the mattress or a supporting Bunkie board would rest having opposing ends wherein each end is fastened to an opposite left and right bed side rail. The bed rail includes a horizontal cross piece which could be of any shape, but may be round, having opposing ends having an upward vertical leg on each end including a 90 degree bend portion with a thickened portion above the bend along with a transition area which transitions to a flattened portion which is wider so as to receive a plurality of apertures therein through which fasteners pass in order to attach the vertical leg portion to the inside surface of the opposing left and right bed side rails.

14 Claims, 2 Drawing Sheets

METAL STAYS FOR BUNK BEDS

BACKGROUND OF THE INVENTION

Field of the Invention

The present invention relates generally to accessories for beds and, more particularly, is concerned with a metal bed stay for a bunk bed.

Description of the Related Art

Devices relevant to the present invention have been described in the related art, however, none of the related art devices disclose the unique features of the present invention.

In U.S. Pat. No. 609,703 dated Aug. 23, 1898, Richardson disclosed a stay for bed slats. In U.S. Pat. No. 3,075,206 dated Jan. 29, 1963, Kendrick, Jr., disclosed a box spring hanger assembly. In U.S. Pat. No. 1,766,190 dated Jun. 24, 1930, Rosenberg, et al., disclosed a bed spring support. In U.S. Pat. No. 2,983,931 dated May 16, 1961, Nelson disclosed a bed slat safety lock bracket. In U.S. Pat. No. 1,676,987 dated Jul. 10, 1928, Line disclosed a portable bed for automobiles of the sedan type. In U.S. Pat. No. 7,895,687 dated Mar. 1, 2011, Schulte disclosed a cross bar system for a bed frame. In U.S. Pat. No. 4,146,940 dated Apr. 3, 1979, Fredmane, et al., disclosed bed rails with crosswire.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses metal bed stays designed primarily for usage on bunk beds, but which could be used on any type bed wherein the metal bed stay includes a horizontal portion upon which the mattress or a supporting Bunkie board would rest having opposing ends wherein each end is fastened to an opposite left and right bed side rail. The bed rail of the present invention includes a horizontal cross piece which could be of any shape, but may be round, having opposing ends having an upward vertical leg on each end including a 90 degree bend portion with a thickened portion above the bend along with a transition area which transitions to a flattened portion which is wider so as to receive a plurality of apertures therein through which fasteners pass in order to attach the vertical leg portion to the inside surface of the opposing left and right bed side rails.

An object of the present invention is to provide a bed stay which is made of metal as opposed to being made of wood. A further object of the present invention is to provide a bed stay which is much stronger than the wooden bed stay. A further object of the present invention is to provide a bed stay which is secured to the opposing side rails of the bed so that they do not fall off the side rails. A further object of the present invention is to provide a metal bed stay which can be easily operated and installed by a user. A further object of the present invention is to provide a metal bed stay which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
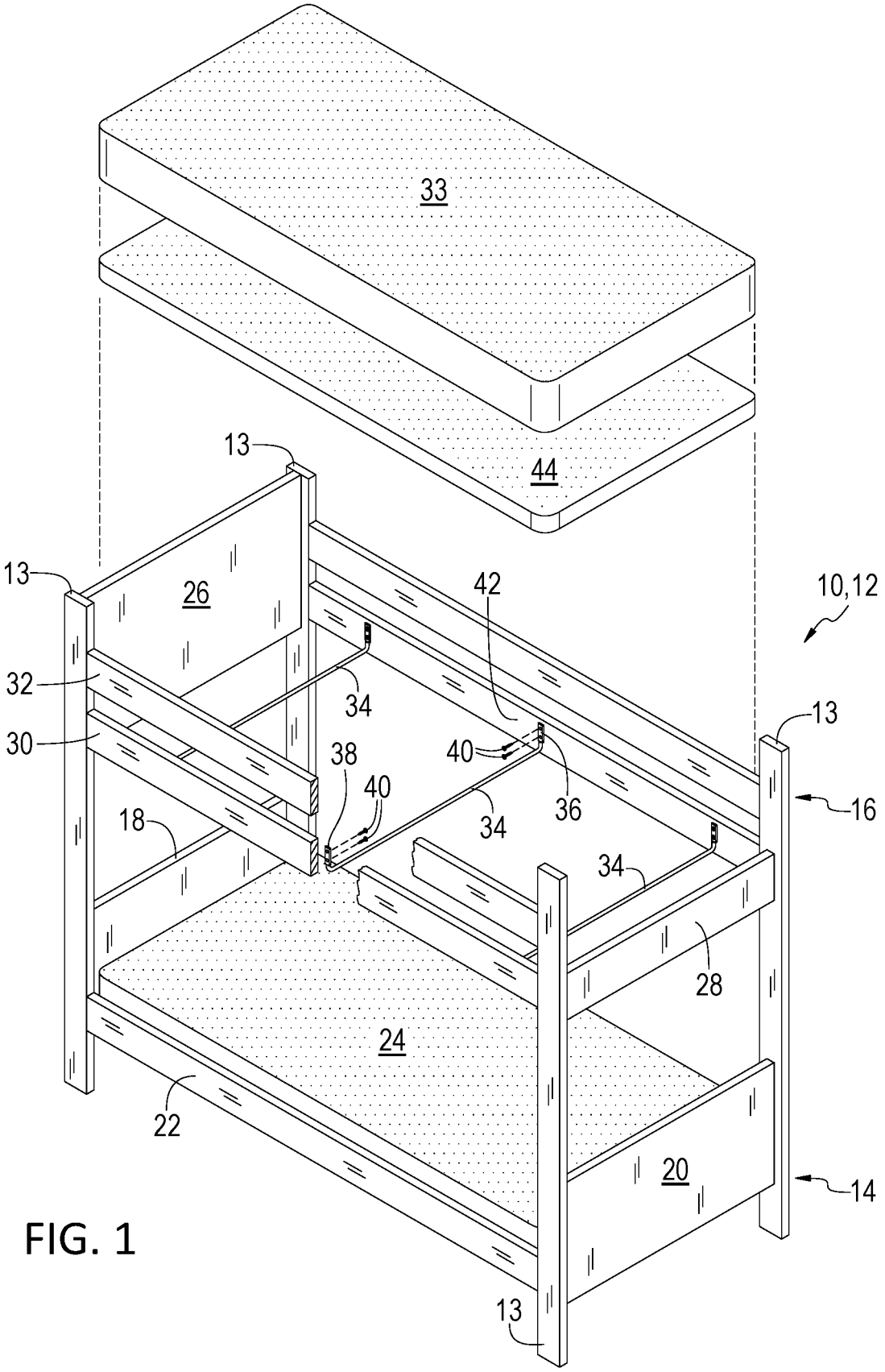
FIG. 1 is a exploded perspective view of the present invention.
Figure 2:
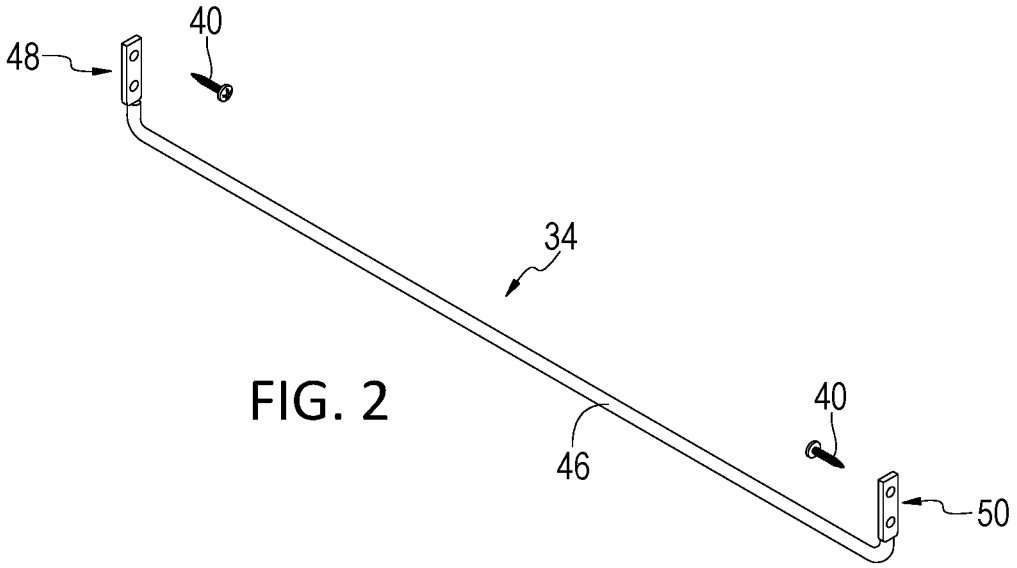
FIG. 2 is a perspective view of a bed stay of the present invention.

With regard to reference numerals used, the following numbering is used throughout

10 the drawings.
12 present invention
12 bunk bed
13 leg
14 lower portion
16 upper portion
18 lower headboard
20 lower footboard
22 lower bed rails
24 lower mattress
26 upper headboard
28 upper footboard
30 first upper bedrail
32 second upper bedrail
33 upper mattress
34 metal bed stays
36 first end
38 second end
40 fasteners
42 inside surface of bed rail
44 Bunkie board
46 horizontal cross piece
48 left vertical leg
50 right vertical leg
52 transition area/portion
54 flattened area/portion
56 aperture
60 bend portion
62 thickened portion
64 shoulder
66 tip
68 inside surface
70 outside surface

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein a metal bed stay designed primarily for bunk beds is disclosed and which is generally indicated by reference number 10.

Turning to FIG. 1, therein is shown the present invention 10 which includes a bunk bed 12 having a lower portion generally shown at 14 and an upper portion generally shown at 16 having a lower headboard 18, a lower footboard 20, lower bedrails 22, and a lower mattress 24 along with an upper headboard 26, a upper footboard 28, a first upper bedrail 30, an second upper bedrail 32, metal bed stays 34 having a first end 36 and a second end 38 and a plurality of fasteners 40 for attaching the opposing end of the bed stay to the opposing inside surface 42 of a lower upper first bedrail 30. The four legs 13 of the bunk bed 12 are also shown disposed on each corner of the bed. Also shown is a Bunkie board 44 upon which the upper mattress 33 rests wherein the Bunkie board 44 rests directly upon the bed stays 34. The present invention 10 thus eliminates the need for conventional wooden bed slats.

Figure 3:
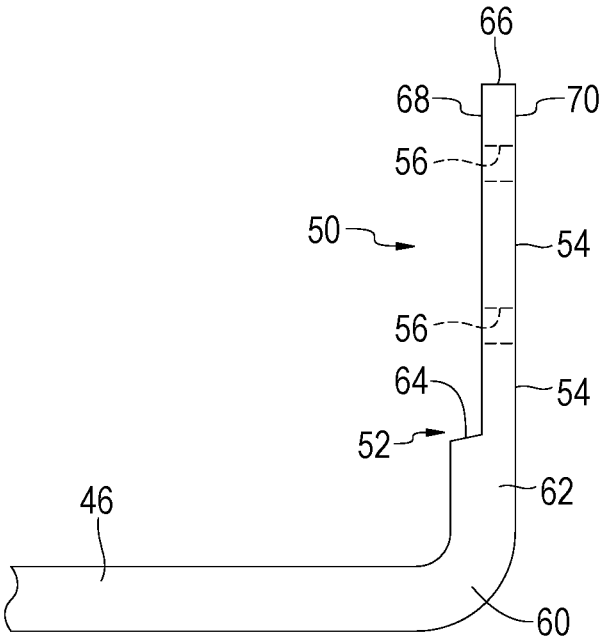
FIG. 3 is an enlarged elevation view of portions of the present invention.
Figure 4:
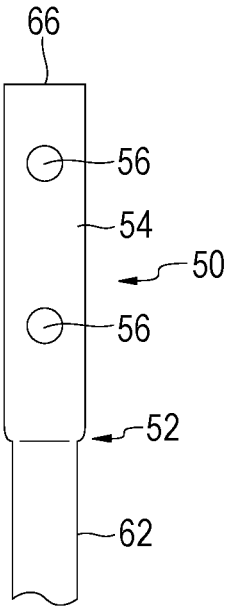
FIG. 4 is an enlarged elevation view of portions of the present invention.
Figure 5:
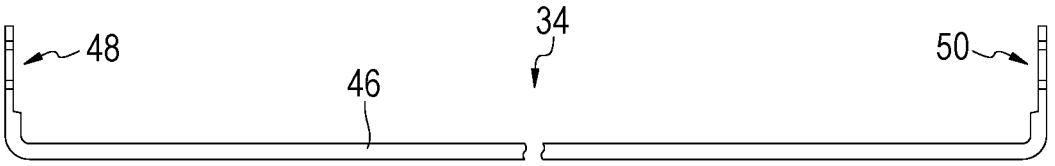
FIG. 5 is an elevational view of a bed stay of the present invention.

Turning to FIGS. 2-5, therein is shown the metal bed stay 34 of the present invention having a horizontal cross piece 46 along with opposing vertical legs 48, 50 with each vertical leg including a 90 degree bend portion 60 with a short thickened portion 62, i.e., having about the same diameter, cross-sectional area, and shape as the horizontal cross piece 46 and being thickened relative to the flattened portion 54, on the vertical leg 50, as best shown in FIGS. 3-4, extending a short distance upwardly before transitioning at 52 into a flattened, widened portion 54 which creates sufficient width to provide a plurality of apertures 56 in each of the vertical leg portions 48, 50 for receiving a fastener 40 corresponding to the number of apertures 56. The flattened, widened portion 54 also provides more room for the edges of the mattresses 24, 33 or Bunkie board 44 to be fit into so that they are not squeezed from a lateral direction inwardly by the vertical legs 48, 50 of each bed stay 34. A somewhat horizontal shoulder 64 is formed at the transition area 52 and a tip 66 is shown along with an inside 68 and outside 70 surfaces of the vertical leg 50 wherein the distance between the inside and outside surfaces is about one-half the distance, i.e., thickness, relative to the diameter/cross-sectional width/thickness of the thickened portion 62.

Use of the present invention 10 being metal bed stays 34 allows a typical bunk bed 12 having a lower portion 14 and an upper portion 16 to use only a total of six bed stays with three on each portion as opposed to as many as 26 wooden bed stays or slats. Use of the metal bed stays 34 of the present invention 10 greatly reduces the weight carried by the left and right bed rails 22, 30 of the bunk bed 12 which greatly reduces the demand for wood and illustrates the positive environmental impact the present invention may have on the environment. The metal bed stays 34 of the present invention 10 may be made of steel and are also much stronger than conventional wooden bed slats which are commonly used on current day bunk beds. As used in this specification, bed stays and bed slats are similar in that they serve the same purpose of providing a bottom support for a mattress or the like.

We claim:

1. A bed stay for a bunk bed, the bunk bed having opposing bed rails on an upper and lower portion, the bed rails having an inside surface, comprising:

(a) a bed stay having an elongated horizontal portion disposed between opposing first and second vertical ends, wherein said first and second vertical ends are each attached to an inside surface of opposing bed rails of the bunk bed;

(b) a ninety-degree bend disposed on each opposing end of said elongated horizontal portion for forming said first and second vertical ends;

(c) a flattened portion disposed on each first and second vertical end having an aperture therein; and (d) a fastener passing through each said aperture for attaching said first and second vertical ends to the bed rail.

2. The bed stay of claim 1, further comprising a thickened portion disposed between said ninety-degree bend and said flattened portion.

3. The bed stay of claim 2, further comprising a transition portion disposed between said thickened portion and said flattened portion.

4. The bed stay of claim 3, further comprising a shoulder disposed on said transition portion.

5. The bed stay of claim 4, wherein said thickened portion has substantially the same cross sectional diameter as said elongated horizontal portion.

6. The bed stay of claim 5, wherein said flattened portion is about one-half the thickness of said thickened portion.

7. The bed stay of claim 6, wherein said bed stay is made of metal.

8. A method for a bed stay for a bunk bed, the bunk bed having opposing bed rails on an upper and lower portion, the bed rails having an inside surface, comprising the steps of:

(a) providing a bed stay having an elongated horizontal portion disposed between opposing first and second vertical ends, wherein the first and second vertical ends are each attached to an inside surface of opposing bed rails of the bunk bed;

(b) forming a ninety-degree bend on each opposing end of the elongated horizontal portion for forming the first and second vertical ends;

(c) flattening a portion on each first and second vertical end having an aperture therein; and (d) providing a fastener for passing through each aperture for attaching the first and second vertical ends to the bed rail.

9. The method of claim 8, further comprising the step of providing a thickened portion between the ninety-degree bend and the flattened portion.

10. The method of claim 9, further comprising the step of providing a transition portion between the thickened portion and the flattened portion.

11. The method of claim 10, further comprising the step of providing a shoulder on the transition portion.

12. The method of claim 11, wherein the thickened portion has substantially the same cross sectional diameter as the elongated horizontal portion.

13. The method of claim 12, wherein the flattened portion is about one-half the thickness of the thickened portion.

14. The method of claim 13, wherein the bed stay is made of metal.

* * * * *